US006802159B1

(12) United States Patent
Kotler

(10) Patent No.: US 6,802,159 B1
(45) Date of Patent: Oct. 12, 2004

(54) ROLL-UP FLOOR TILE SYSTEM AND THE METHOD

(75) Inventor: Daniel Kotler, Salt Lake City, UT (US)

(73) Assignee: Snap Lock Industries, Inc., Salt Lake City, UT (US)

( * ) Notice: Subject to any disclaimer, the term of this patent is extended or adjusted under 35 U.S.C. 154(b) by 0 days.

(21) Appl. No.: 10/159,486

(22) Filed: May 31, 2002

(51) Int. Cl.[7] ..... E01C 5/20; E04B 5/00

(52) U.S. Cl. ..... 52/177; 52/506.01; 52/592.1; 404/35; 404/41

(58) Field of Search ..... 52/384, 386, 387, 52/390, 391, 392, 177, 181, 71, 389, 747.11, 506.01, 592.1; 404/35, 41, 47; 15/215

(56) References Cited

U.S. PATENT DOCUMENTS 738,704 A * 9/1903 Semmer ..... 52/746.12
1,420,775 A * 6/1922 Stanwood ..... 52/177
1,625,187 A * 4/1927 Birch ..... 52/177
3,279,138 A * 10/1966 Dittmar ..... 428/50
3,284,819 A * 11/1966 Nissen ..... 5/420
3,319,392 A * 5/1967 Fitzgerald ..... 52/389
3,579,410 A * 5/1971 Barrett ..... 428/50
3,717,247 A * 2/1973 Moore ..... 206/321
3,909,996 A * 10/1975 Ettlinger et al. ..... 52/177
4,226,060 A * 10/1980 Sato ..... 52/99
4,287,693 A * 9/1981 Collette ..... 52/177
4,543,765 A * 10/1985 Barrett ..... 52/747.11
4,584,221 A * 4/1986 Kung ..... 428/44
4,715,743 A * 12/1987 Schmanski ..... 404/9
5,014,488 A * 5/1991 Evangelos et al. ..... 52/746.12
5,033,241 A * 7/1991 Max ..... 52/71
5,275,502 A * 1/1994 Glaza et al. ..... 404/35
5,323,575 A * 6/1994 Yeh ..... 52/177
5,527,128 A * 6/1996 Rope et al. ..... 404/35
5,815,995 A * 10/1998 Adam ..... 52/177
5,833,386 A * 11/1998 Rosan et al. ..... 404/36
5,950,378 A * 9/1999 Council et al. ..... 52/177
6,098,354 A * 8/2000 Skandis ..... 52/177
6,467,224 B1 * 10/2002 Bertolini ..... 52/177

FOREIGN PATENT DOCUMENTS

CA 2394715 * 11/2003 ..... E04F/15/12

* cited by examiner

*Primary Examiner*—Robert Canfield
(74) *Attorney, Agent, or Firm*—Holland & Hart

(57) ABSTRACT

A plurality of interlocking tile pieces form a generally flat traffic-carrying surface. The tile are locked together in a manner to form a plurality of non-bendable tile joints. The tile includes a hinge or fold line along a first axis and a hinge or fold line along a second axis. The hinges allow the multi-tile traffic carrying surface to be rolled up into a hollow tube from any direction along one of the axes, beginning at any edge of the traffic carrying surface. The rolled-up floor covering is made up of a plurality of tile panels.

20 Claims, 9 Drawing Sheets

16
22
21
45
43
42
12
20
19
48
47
15
40
41
14
10
11
23
18
17

ROLL-UP FLOOR TILE SYSTEM AND THE METHOD

FIELD OF THE INVENTION

This invention relates to floor tiles, and more particularly to interlocking floor tiles for covering a floor or other surface.

BACKGROUND OF THE INVENTION

Floor coverings and ground coverings, both permanent and temporary tiles, are well known. For example U.S. Pat. Nos. 3,438,312, 4,436,779, 4,054,987, 5,791,114, 6,026,625 and 6,098,354 are of interest and are incorporated herein by this reference.

Interlocking floor tiles, of the type that are typically installed on top of an existing floor, have traditionally required installation by placing one tile down on the floor after the other and interlocking the respective tiles through some type of interlocking system. When the tiles need to be removed, even temporarily, the tiles have traditionally been required to be disassembled one tile at a time. This is, of course, time consuming and very inefficient, particularly where the floor tiles are to be reinstalled in a short period of time.

While tile of these prior types have been generally useful for their intended purpose, the need remains in the art for a floor tile system will that assemble into a unitary and structurally stable floor covering, which can be rolled up, either in whole or in part, rather than requiring that the multi-tile floor be disassembled into its plurality of individual tile.

SUMMARY OF THE INVENTION

The present invention provides a thin and generally flat or planar ground/floor tile having edge-located interlocking members, both male and female, such that a plurality of individual tile pieces can be assembled into a floor covering. In various embodiments, the floor covering may have a square outer periphery, a rectangular outer periphery, or a more complex outer periphery that may contain a plurality of square, rectangular, or even curved edges. Irrespective of the outer periphery of a floor covering, the multi-tile floor includes four or more orthogonally extending exterior floor edges.

While the invention will be described while making reference to floor tile that are square, the spirit and scope of the invention is not to be limited to this particular right-angle quadrilateral shape.

Each of the tile in accordance with the invention includes at least one orthogonally extending hinge or fold line, such that a multi-tile floor can be rolled up, beginning at one floor-edge, without the need to disassemble the floor into its individual tile.

In this manner, and in accordance with the invention, the multi-tile floor can be rolled up, as a whole or in small sections, for example, to move the floor or to store the floor. Rolling up of the floor is started by manually lifting any one of the floor's exterior edges, and subsequently pivoting this lifted edge back about the hinge or fold line to start the roll-up process. Sequentially lifting the next tile section and pivoting it relative to the next hinge or fold line (which runs parallel to the first hinge or fold line) continues the roll-up process. The roll-up process causes the floor tiles, which remain interlocked, to form a hollow tubular shape, as tile are bent along the above-described hinges or fold lines extending parallel to the axis of the tubular floor roll.

In one embodiment, each tile in accordance with the invention was about one foot square, and the surface of each tile contained four linear fold lines. Each individual fold line is located parallel to and about three inches from one of the four orthogonal edges of the tile. In this way, each tile was divided into nine areas, i.e., four 3×3 inch corner areas, four 3×6 inch middle-edge areas, and one 6×6 inch center-area.

More generally stated, each of the four linear fold lines or hinges is located one unit of measurement from one of the four linear tile edges. In this way, the tile is divided into nine areas, i.e., four one-unit-by-one-unit corner areas, four one-unit-by-two-unit middle-edge areas, and one two-unit-by-two-unit center-area. When a plurality of these square four-unit-by-four-unit tile are assembled into a multi-tile floor, the multi-tile floor contained a plurality of two-unit-by-two-unit center-floor areas, four one-unit-by-one-unit corner areas, and a plurality of one-unit-by-two-unit floor-edge areas.

The abutting edges of each tile are, in one embodiment, secured to up to four adjacent tile. That is, each tile's edge-disposed locking members operates to physically attach the tile to an adjacent tile. The locking members are constructed and arranged using male and female members so that the locking members do not release when the multi-tile floor is rolled. Thus, at least in the embodiment shown, the assembled floor's abutting edges do not comprise floor fold lines or hinges in accordance with the invention.

The foregoing and other features, utilities and advantages of the invention will be apparent from the following more particular description of a preferred embodiment of the invention as illustrated in the accompanying drawings.

DETAILED DESCRIPTION OF THE INVENTION

Figure 1:
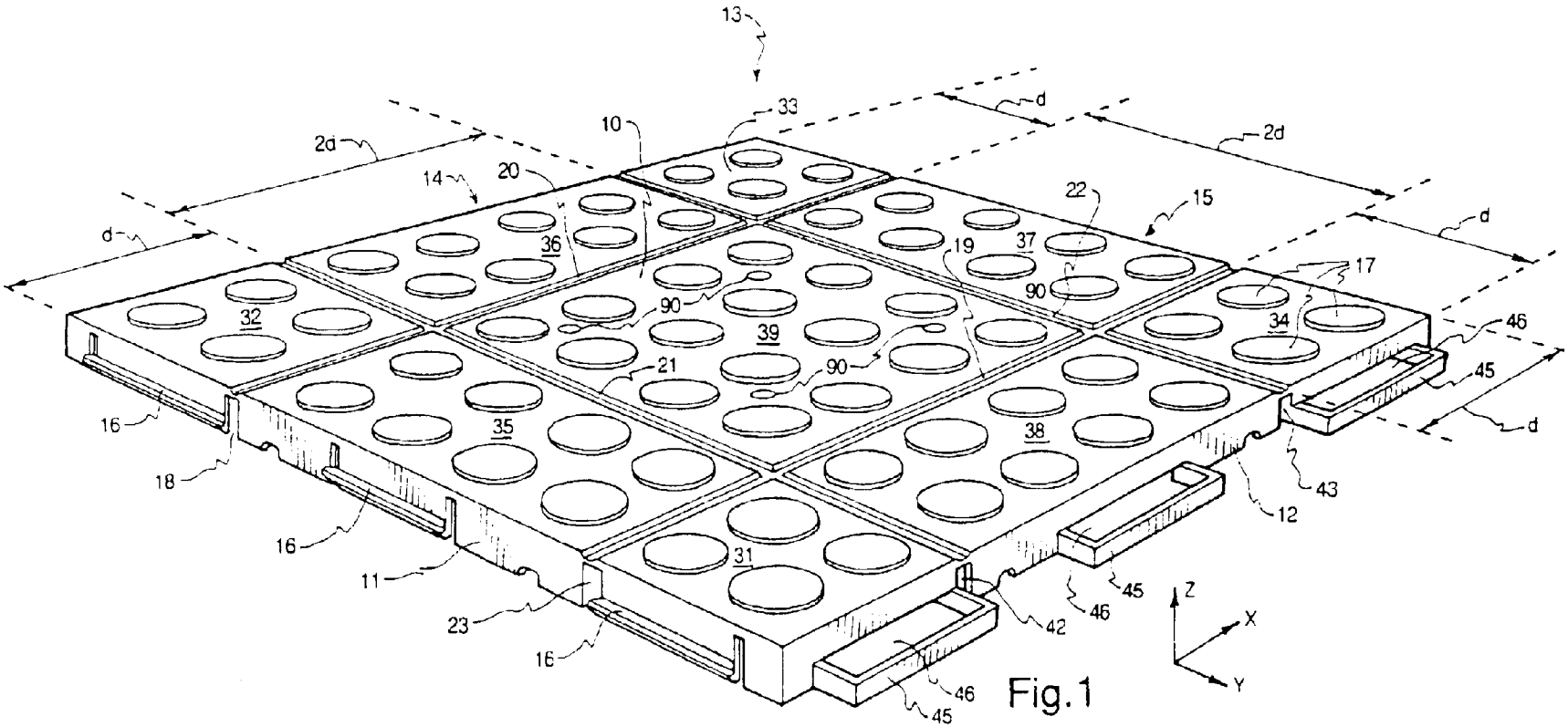
FIG. 1 is a top, front-side and right-side perspective view of a tile apparatus in accordance with the invention.

FIG. 1 shows the top or traffic-carrying surface 10 of a tile 13 constructed and arranged in accordance with the invention. An X-Y-Z three-dimensional coordinate system is shown relative to the tile apparatus shown in FIG. 1.

The top surface 10 of tile 13 (also seen in FIG. 3) is a generally flat, planar surface that extends in the X-Y plane of the tile. In one embodiment, top surface 10 is a one-foot by one-foot square.

Top surface 10 of tile 13 includes a relatively high-friction surface, such as, for example, a slightly raised pattern of circles 17 that provide a degree of friction to top surface 10. Of course, any other surface patterns or textures can be used to provide a traction-type of top surface 10 without departing from the scope of the present invention.

When tile 13 is to be used out of doors, drain holes 90 may be provided within top surface 10. For purposes of drawing simplicity, only a few drain holes 90 are shown in FIGS. 1, 3.

Figure 2:
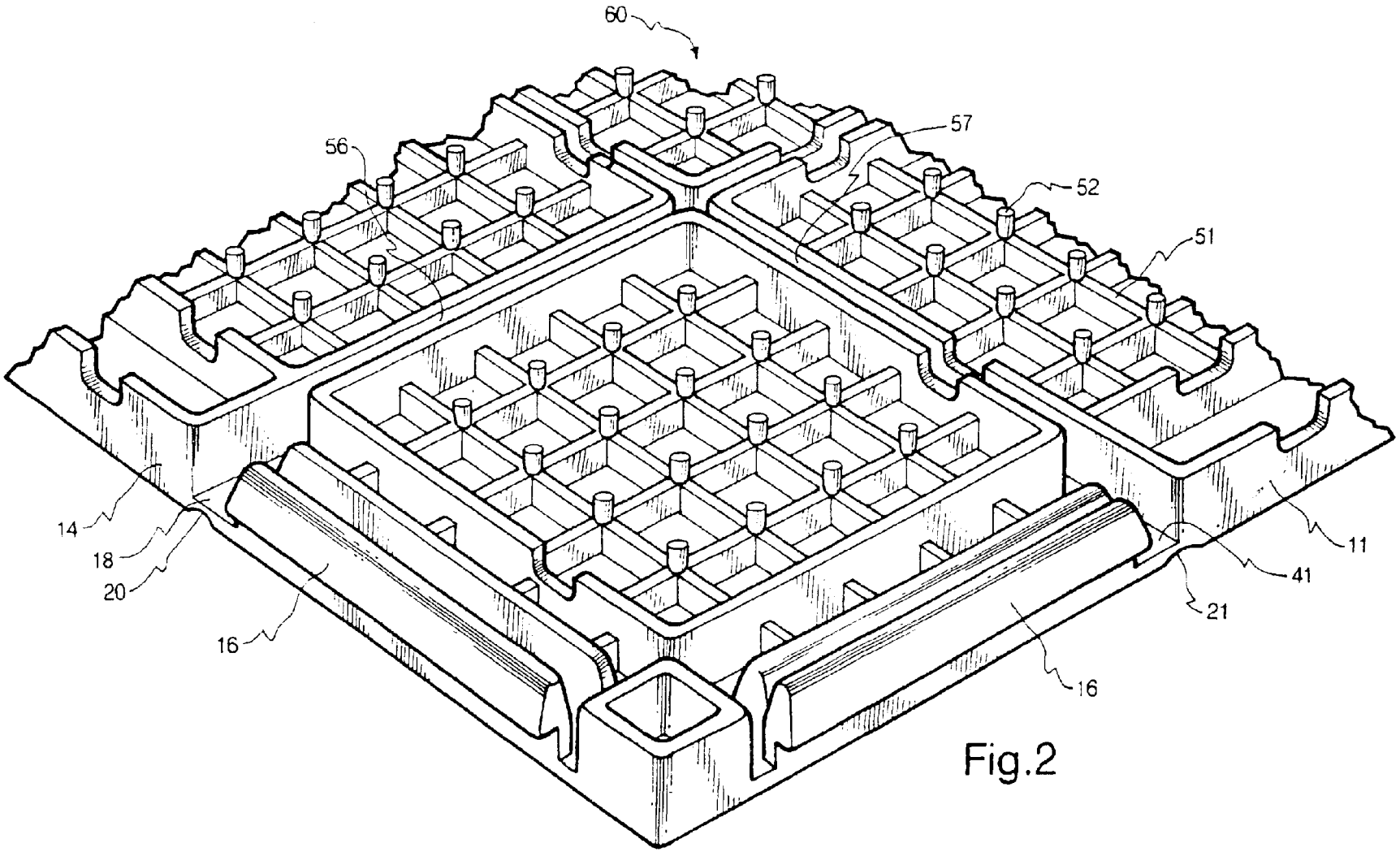
FIG. 2 is a perspective view that shows the detailed construction and arrangement of the bottom front-left corner of the tile apparatus of FIG. 1. i.e., the corner of the tile that has resilient tile clamping fingers or male locking members on the two tile edges that join at a 90 degree angle.
Figure 3:
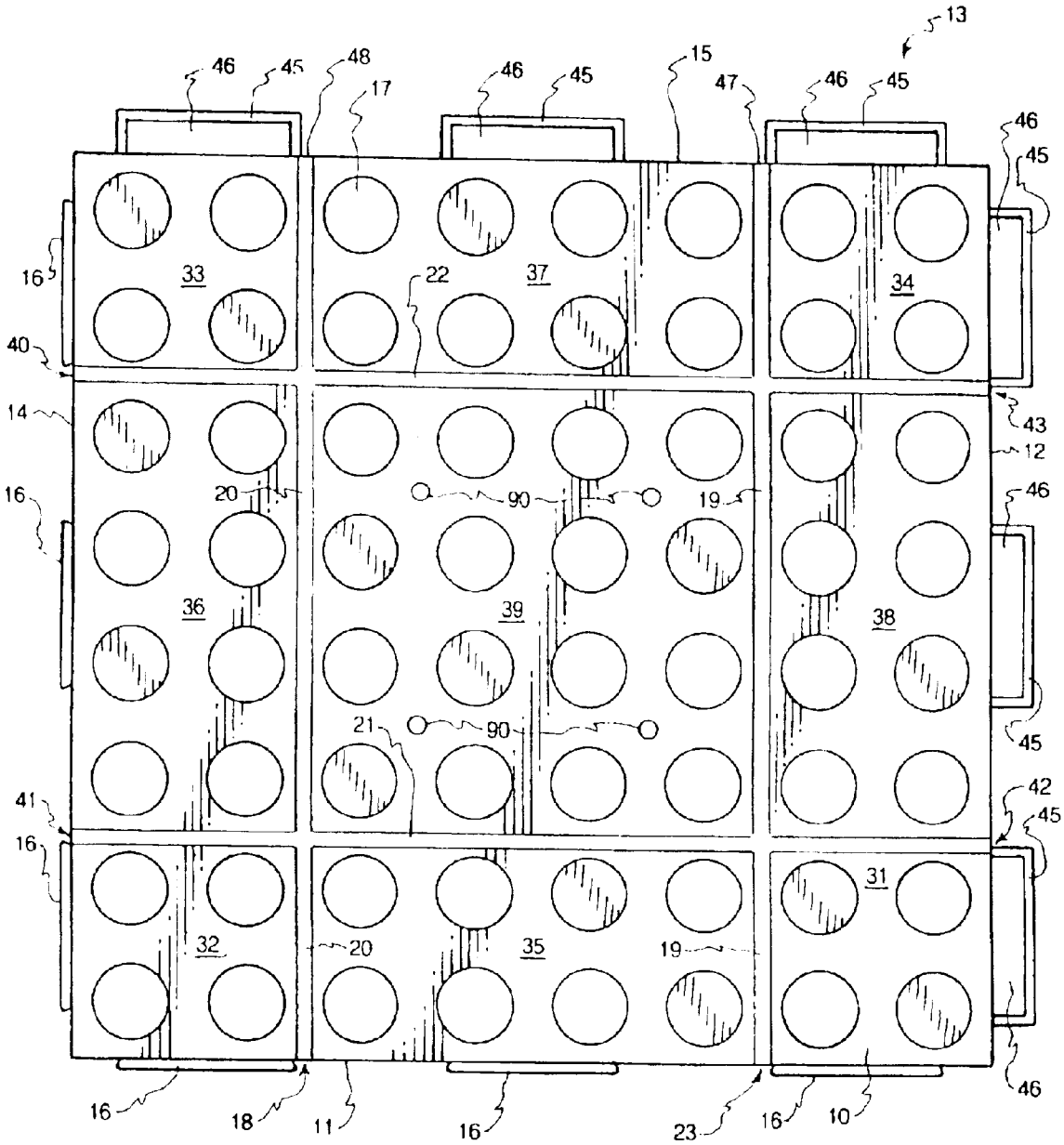
FIG. 3 is a top view of the tile apparatus of FIG. 1 this figure showing the top or traffic-carrying surface of the tile, and this figure showing four tile bend lines embossed into the tile's traffic-carrying surface.
Figure 4:
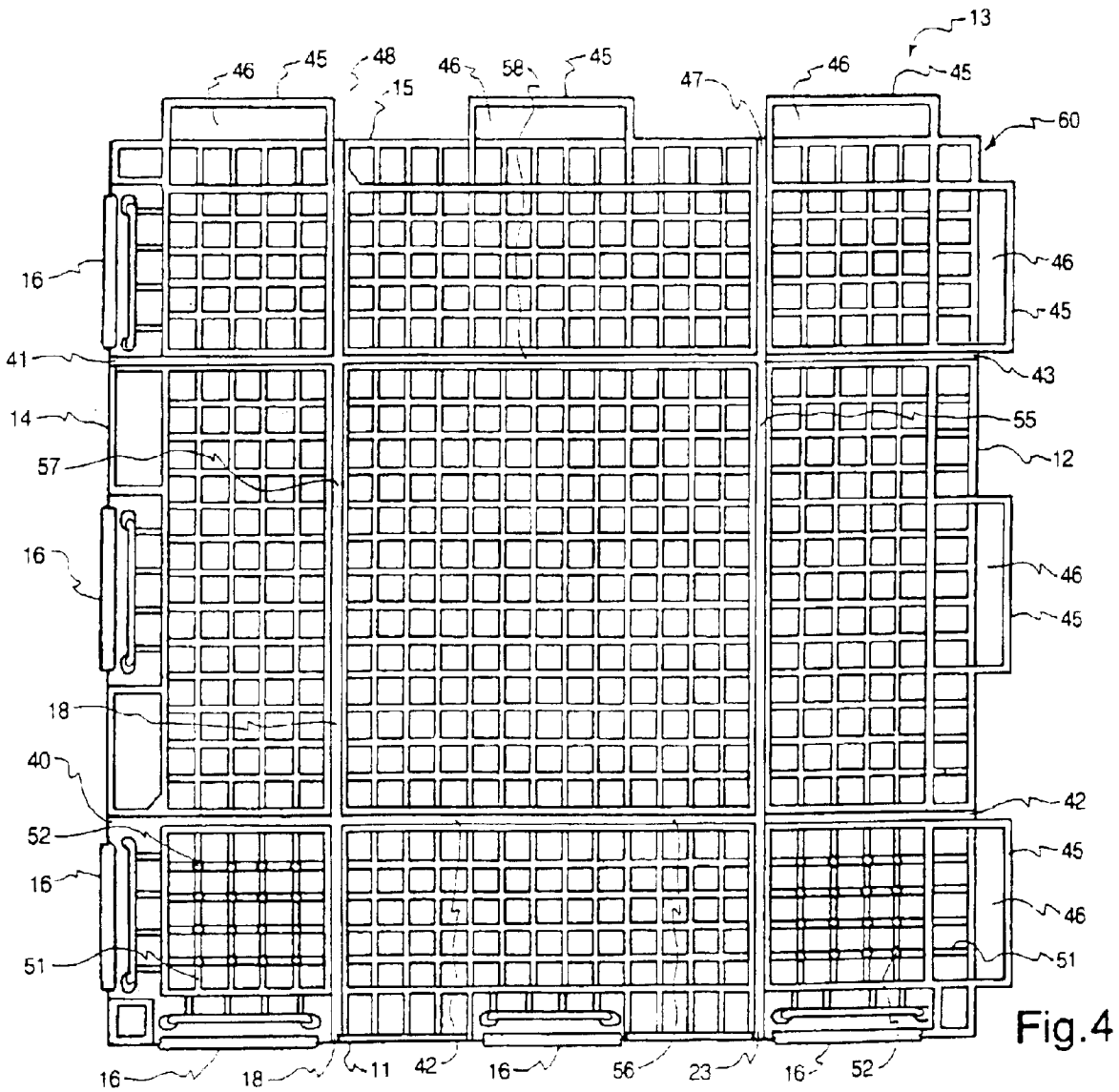
FIG. 4 is a bottom view of the tile apparatus of FIG. 1, this figure showing a grid-like network of walls and support legs molded into the tile's bottom surface, and this figure showing four tile bend channels that positionally underlie the four tile fold lines or hinges that are shown in FIG. 3.

In accordance with the invention, the tile's top surface 10 contains a first X-direction tile hinge or bend line 19, a second X-direction tile hinge or bend line 20, a first Y-direction tile hinge or bend line 21 and a second Y-direction tile hinge or bend line 22 (also see FIG. 3). The X-direction is considered a first axis, and the Y-direction is considered a second axis. As will be apparent, the top-surface tile hinges or bend lines positionally overlie four tile fold channels that are formed in the bottom surface of tile 13, for example as is shown in FIGS. 2 and 4. The hinges or bend lines are, in one embodiment, living hinges as understood by those skilled in the art. The hinges are movable independently of one another. That is, one hinge may move without necessarily requiring another hinge to move.

As is shown in FIG. 1, in one embodiment of the invention, the four tile bend lines 19–22 extended completely across the top surface 10 of tile 13, without interruption. Bend lines 19–22 can be formed, for example, by an injection molding process that embosses bend lines 19–22 a short Z-distance into the X-Y planar top surface 10 of tile 13. That is, the thickness of the material used to mold the tile 13 is reduced at fold lines 19–22 relative to the thicknesses of surface areas 31–39, which creates a hinge at fold lines 19–22.

As will be discussed in greater detail below relative to FIGS. 10 and 11, and as is also shown in FIG. 1, each of the four bend lines 19–22 is physically spaced from its adjacent and parallel tile edge by a distance d, the two parallel X-direction bend lines 19 and 20 are physically spaced from each other by two times this distance (i.e., a distance 2d), and the two parallel Y-direction bend lines 21 and 22 are physically spaced from each other by a similar distance 2d. One example where tile 13 is a one foot square, the dimension d would be approximately 3 inches.

The four tile bend lines 19–22 operate to divide the top surface 10 of tile 13 into nine sub-surface areas (i.e., four d-width by d-width corner areas 31–34, 4d-width by 2d-width middle-edge areas 35–38, and 2d-width by 2d-width middle-tile area 39 (see also FIG. 3).

As will be apparent, and as will be described relative to FIGS. 10 and 11, when a plurality of tiles 13 in accordance with the invention are mutually interlocked to form a multi-tile floor, and when it thereafter becomes necessary to move or remove the multi-tile floor, the floor, either in whole or in part, can be rolled up into the shape of a hollow tube that is formed by a plurality of connected flat tiles or panels which are each allowed to articulate relative to one or more fold lines or hinges, with each flat tile panel extending parallel to the axis of the tube. Given the interconnecting edges of adjacent tiles, each tile subsection has a 2d-wide dimension. That is, the floor roll consists of multiple flat tile subsections consisting of multiple flat panel subsections made up of flat tile areas 35, 39, 37, and multiple flat panel subsections made up of flat tile areas 31, 38, 34 that are locked to flat tile areas 32, 36, 38.

The thickness dimension of tile 13 extends in the Z-direction. Tile 13 is of generally a uniform thickness. For example, a one foot square tile 13 is about ½ inch thick.

As shown in FIG. 1, the front wall or edge 11 tile 13 (also seen in FIG. 5) extends in the Y-Z plane. Front wall 11 contains two wall notches 18, 23 aligned, respectively, with X-direction bend line 20 and X-direction bend line 19. The presence of notches 18 and 23 in the tile's front wall 11 accommodate the bending of tile 13 about bend lines 20 and 19. The front wall 11 of tile 13 also contains three resilient clamping fingers or male members 16 that operate, as will be described with reference to FIG. 9, to firmly and relatively permanently secure the front wall 11 of a tile 13 to the top wall 15 of an adjacent tile 13, to thus form a 2d-wide by 2d-wide flat tile panel that contains the tile areas 32, 35, 31 of a first tile 13 locked to the tile areas 33, 37, 34 of a second tile 13.

Figures 5, 6, 7, 8:
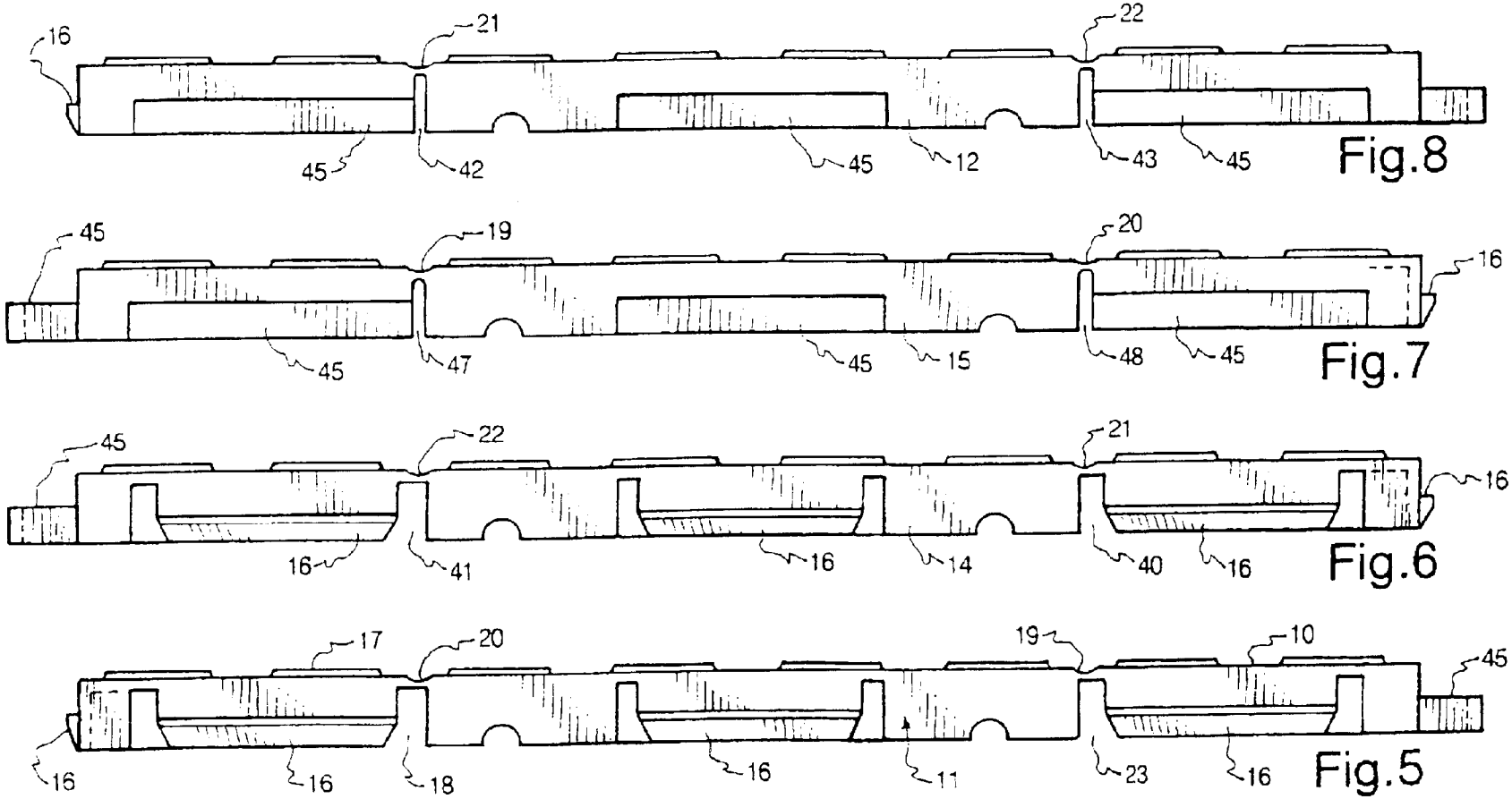
FIG. 5 shows the front wall or edge of the tile apparatus of FIG. 1, this figure showing three resilient tile clamping fingers or male locking members located within the tile's front wall, and this figure showing two wall notches positioned to correspond to a first set of cooperating tile bend lines and tile bend channels shown in FIGS. 3 and 4.
FIG. 6 shows the left wall or edge of the tile apparatus of FIG. 1, this figure showing three resilient tile clamping fingers located within the tile's left wall, and this figure showing two wall notches positioned to correspond to a second set of cooperating tile bend lines and tile bend channels shown in FIGS. 3 and 4.
FIG. 7 shows the top wall or edge. of the tile apparatus of FIG. 1, this figure showing three resilient tile clamping loops or female locking members located within the tile's top wall, and this figure showing two wall notches positioned to correspond to a third set of cooperating tile bend lines and tile bend channels shown in FIGS. 3 and 4.
FIG. 8 shows the right wall or edge of the tile apparatus of FIG. 1, this figure showing three resilient tile clamping loops or female locking members located within the tile's right wall, and this figure showing two wall notches positioned to correspond to a first set of cooperating tile bend lines and tile bend channels shown in FIGS. 3 and 4.

The left wall or edge 14 of tile 13 that extends in the X-Z plane is best seen in FIG. 6. The tile's left wall 14 is generally identical in construction and arrangement to the above-described front upstanding wall 11. That is, left upstanding wall 14 contains two wall notches 40 and 41 that are aligned respectively with the tile's Y-direction hinge or bend line 22 and Y-direction hinge or bend line 12. The presence of notches 40 and 41 in the tile's left upstanding wall 14 accommodate the bending of tile 13 about hinges or bend lines 22 and 21. The left upstanding wall 11 of tile 13 also contains three resilient clamping fingers or male locking members 16 that operate, as will be described with reference to FIG. 9, to firmly and relatively permanently (i.e., the securement is "permanent" so long as the floor covering created by the assembled individual floor tiles remains installed on a floor or other surface area; the word "relatively" means that the individual floor tiles can be disassembled) secure the left wall 14 of the first tile 13 to the right wall 12 of a second tile 13, to thus form a 2d-width by 4d-width flat tile panel that contains the flat tile areas 32, 36, 33 of the first tile 13 locked to the flat tile areas 31, 38, 34 of the second tile 13.

The right upstanding wall or edge 12 of tile 13 (also seen in FIG. 8) extends in the X-Z plane and contains two wall notches 42 and 43 that are aligned respectively with Y-direction hinge or bend line 21 and Y-direction hinge or bend line 22. The presence of notches 42 and 43 within the tile's right wall 12 accommodate the bending of tile 13 about bend lines 21 and 22. Right upstanding wall 12 also includes three clamping loops or female locking members 45. As can be seen in FIGS. 1, 3, 4 and 9, each of the rigid clamping loops 45 defines an aperture or void 46 into which a resilient clamping finger 16 is inserted when two adjacent tile 13 are mounted to each other. Clamping loops 45 operate, as will be described with reference to FIG. 9, to firmly and relatively permanently secure the right wall 12 of a first tile 13 to the left wall 14 of a second tile 13, to thus form a 2d-width by 4-d width flat tile panel that contains the flat tile areas 31, 38, 34 of the first tile 13 locked to the flat tile areas 32, 36, 33 of the second tile 13.

The top upstanding wall or edge 15 of tile 13 (also seen in FIG. 7) extends in the Y-Z plane, and top wall 15 contains two wall notches 47 and 48 that are aligned respectively with X-direction hinge or bend line 19 and X-direction hinge or bend line 20. The presence of notches 47 and 48 within the tile's top upstanding wall 15 accommodate the bending of tile 13 about bend lines 19 and 20. Top wall 15 also includes three female locking members or clamping loops 45. The right upstanding wall or edge 12 of tile 13 (also seen in FIG. 8) extends in the X-Z plane and contains two wall notches 42 and 43 that are aligned respectively with Y-direction hinge or bend line 21 and Y-direction hinge or bend line 22. The presence of notches 42 and 43 within the tile's right wall 12 accommodate the bending of tile 13 about bend lines 21 and 22. Right upstanding wall 12 also includes three female locking members or clamping loops 45. As can be seen in FIGS. 1, 3, 4 and 9, each of the rigid clamping loops 45 defines an aperture or void 46 into which a resilient male locking member or clamping finger 16 is inserted when two adjacent tile 13 are mounted to each other. Clamping loops 45 operate, as will be described with reference to FIG. 9, to firmly and relatively permanently secure the top wall 15 of a first tile 13 to the front wall 11 of a second tile 13, to thus form a 2d-wide by 4d-wide flat tile panel that contains the tile areas 34, 37, 33 of the first tile 13 locked to the flat tile areas 31, 35, 32 of the second tile 13.

The bottom side or underside 60 of tile 13 is shown in FIGS. 2 and 4. FIG. 4 shows the overall view, and FIG. 2 shows a partial, enlarged view of one corner of the tile 13. With reference to FIG. 2, the underside 60 of tile 13 includes a network of relatively small ribs 51 that extend in the X-direction and the Y-direction, and a plurality of feet 52 that extend in the Z-direction. Ribs 51 prevent the bending of tile areas 31–39, and legs 52 aid in physically supporting the tile's traffic-bearing surface 10. For purposes of simplicity, only a few of the feet 52 are shown in FIG. 4.

In the above example embodiment of the invention, ribs 51 and feet 52 can be manufactured so as to extend in the Z-direction any desired height. In the embodiment of FIG. 2, the overall height of the tile 13 (in the Z-direction) is approximately ½ inch.

A feature of the invention provides that the tile's bottom surface 60 that includes rib/leg support network 51/52 is constructed and arranged so as not to interfere with the bending of tile 13 in the X-direction about bend lines 19 and 20, and so as not to interfere with the bending of tile 13 in the Y-direction about hinges or bend lines 21 and 22.

More specifically, the FIGS. 2 and 4 bottom surface 60 that includes rib/leg support network 51/52 four uninterrupted and orthogonal bend channels 55–58 which cooperate with both of the upstanding wall notches provided in the four side walls of the tile and the bend lines that are embossed into the top surface 10 of the tile.

X-direction bend channel 55 is aligned with the wall notch 23 formed in front wall 11, with the wall notch 47 formed in top wall 15, and with the X-direction bend line 19 embossed in the tile's top surface 10.

X-direction bend channel 57 is aligned with the wall notch 18 formed in front wall 11, with the wall notch 48 formed in top wall 15, and with the X-direction bend line 20 embossed in the tile's top surface 10.

Y-direction bend channel 56 is aligned with the wall notch 40 formed in left wall 14, with the wall notch 43 formed in right wall 12, and with the Y-direction bend line 22 embossed in the tile's top surface 10.

Y-direction bend channel 58 is aligned with the wall notch 41 formed in left wall 14, with the wall notch 43 formed in right wall 12, and with the Y-direction bend line 21 embossed in the tile's top surface 10.

In one embodiment of the invention, tile 13 comprises a single-piece injection molded tile made of plastic, preferably high impact copolymer polypropylene. It is to be understood, however, that any suitable plastic or other material may be used with the present invention.

As stated above, the tile's left edge 14 is identical in construction and arrangement to the tile's front edge 11 in that both of these edges contain three resilient clamping fingers 16, and the tile's top edge 15 is identical in construction and arrangement to the tile's right edge 12 in that both of these edges contain three clamping loops 45.

Figure 9:
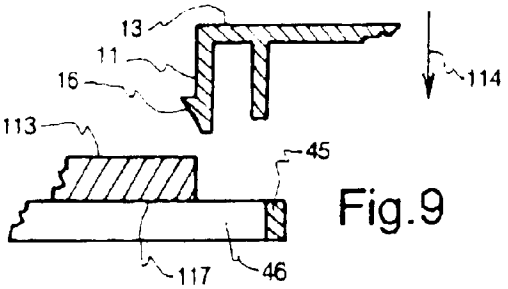
FIG. 9 shows a clamping finger or male locking member of a first tile located directly above a clamping loop or female locking member of a second tile, such that upon forcing the first tile downward the first tile's clamping finger deflects toward the tile from which it extends as the clamping finger enters a void or aperture defined by the clamping loop carried, in turn, by the second tile's edge, whereupon the clamping finger restores to its static position and firmly locks the first tile to the second tile.

FIG. 9 shows the clamping-finger or male locking member edge of a first tile 13 in accordance with the invention located directly above the clamping-loop or female locking member edge of a second tile 113 in accordance with the invention. Upon forcing the first tile 13 downward, the first tile's clamping finger 16 deflects to the right as it enters a void 46 defined by the clamping loop 45 carried by the second tile 113. As the first tile 13 is pressed downward (see arrow 114), clamping finger 16 resiliently restores to its original position to the left and its catch 116 latches under surface 117, to thereby firmly lock the first tile 13 to the second tile 113 with the top surfaces of the two tile 13 and 113 positioned in generally the same X-Y plane.

Figure 10:
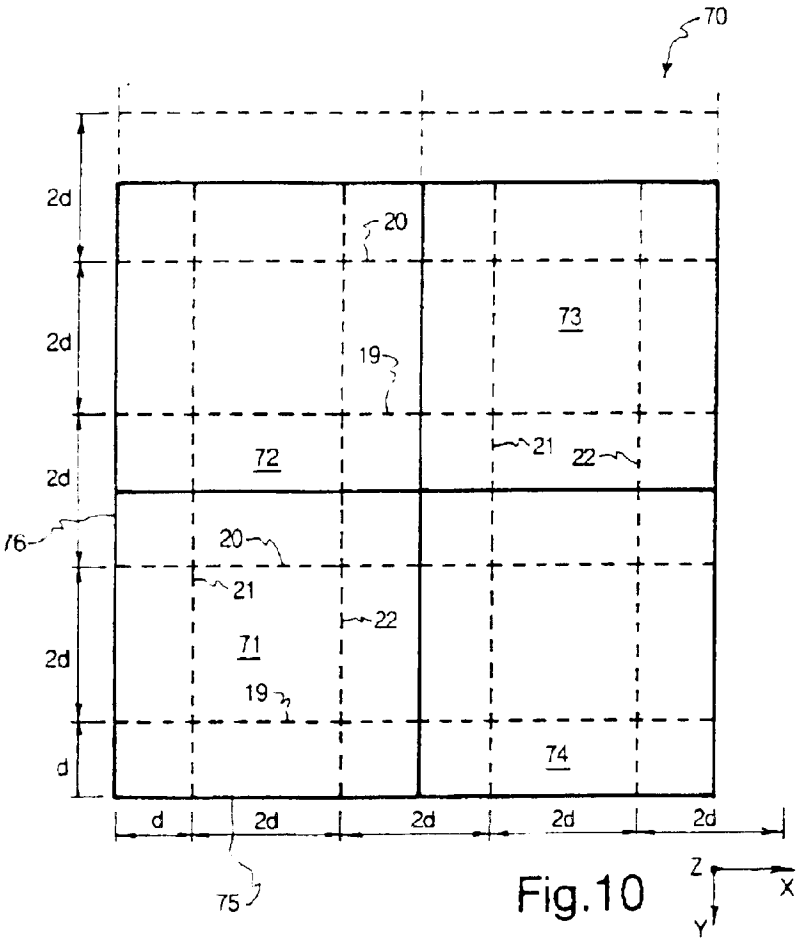
FIG. 10 is a top view of a four-tile assembly in accordance with the invention wherein each tile within the floor is constructed and arranged as is shown in FIG. 1, thus producing a floor that can be bent and then rolled up in either of two orthogonal directions.

FIG. 10 is the top view of portion of a multi-tile floor 70 in accordance with the invention wherein each tile 13 that is within the floor is constructed and arranged as is described above, thus producing a floor 70 that can be bent and then rolled up in either of two orthogonal directions. FIG. 10 shows only four tile 71–74 that are interlocked to form one corner of floor 70, this floor having X-direction bend-lines 19 and 20 and Y-direction bend lines 21 and 22, as above-described. As described above, when it is desired to roll up floor 70, it is only required to lift up edge 75 of floor 70, or to lift up edge 76 of floor 70.

Assuming that rolling of floor 70 begins by lifting edge 75, and then moving lifted edge 75 over floor 70 in the Y-direction, a floor roll is produced whose major region consists of a series of flat floor panels that each have a width of 2d (6 inches wide in the above example), and whose two roll-end floor panels have a width of 2d (3 inches in the above example, with axis of the floor roll extending in the X-direction.

When rolling of the floor 70 begins by lifting edge 76 and then moving lifted edge 76 in the X-direction, over the floor, a similar floor roll is produced wherein the axis of the floor roll extends in the Y-direction.

Figure 11:
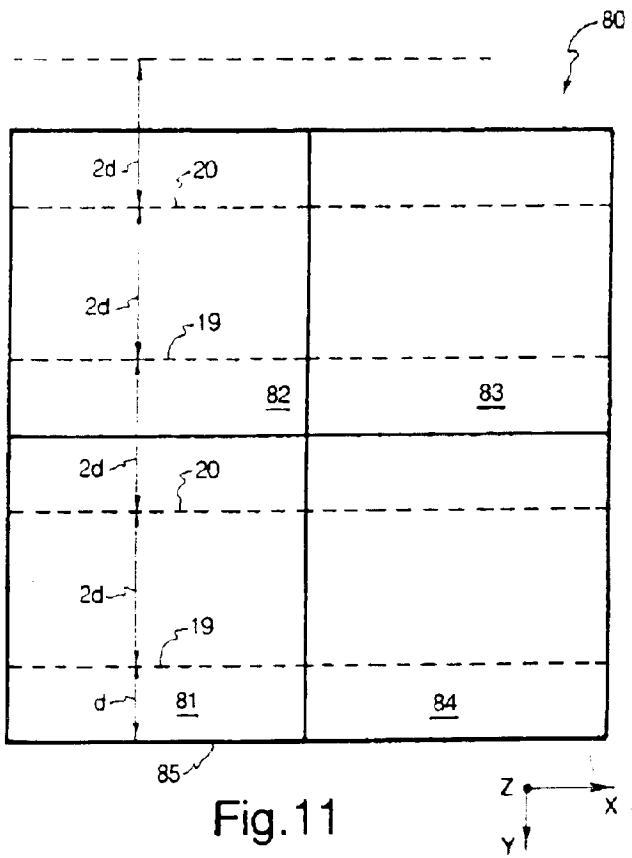
FIG. 11 is the top view of a four-tile corner portion of a multi-tile floor in accordance with the invention wherein each tile within the floor is constructed and arranged to contain fold lines or hinges that extend in only one direction, thus producing a floor that can be bent and then rolled up to form a tubular shape whose axis is parallel to the fold lines being utilized.

FIG. 11 is the top view of portion of a multi-tile floor 80 in accordance with the invention wherein each tile 13 within floor 80 is constructed and arranged to contain fold lines 19 and 20 that extending only the X-direction (or alternatively fold lines 21 and 22 that extend only in the Y-direction). Again, only one four-tile corner of floor 80 is shown, this corner containing four interlocked floor tile 81–84 in accordance with the invention.

The tile within multi-tile floor 80 are as described above, with the exception that the top surface, the side walls and the bottom surface of the tile are constructed and arranged to facilitate the operation of fold lines 19 and 20 that extend only in the X-direction, or to facilitate the operation of fold lines 21 and 22 that extend in only the Y-direction. That is, the side walls of the tile need include only bend notches that cooperate with the top surface bend lines, and the underside of the tile need include only bend channels that cooperate with the top surface bend lines.

In the FIG. 11 embodiment of the invention floor 80 that can be bent and then rolled up to form a tubular shape whose axis is parallel to the fold lines 19 and 20 (the X-direction) only when its edge 85 is lifted up and then moved in the Y-direction over floor 80. The axis of the resulting floor roll extends in the X-direction, and the major portion of the floor roll is made up of floor panels having a width of 2d, with end panels of the floor roll have a width of d.

Figure 12:
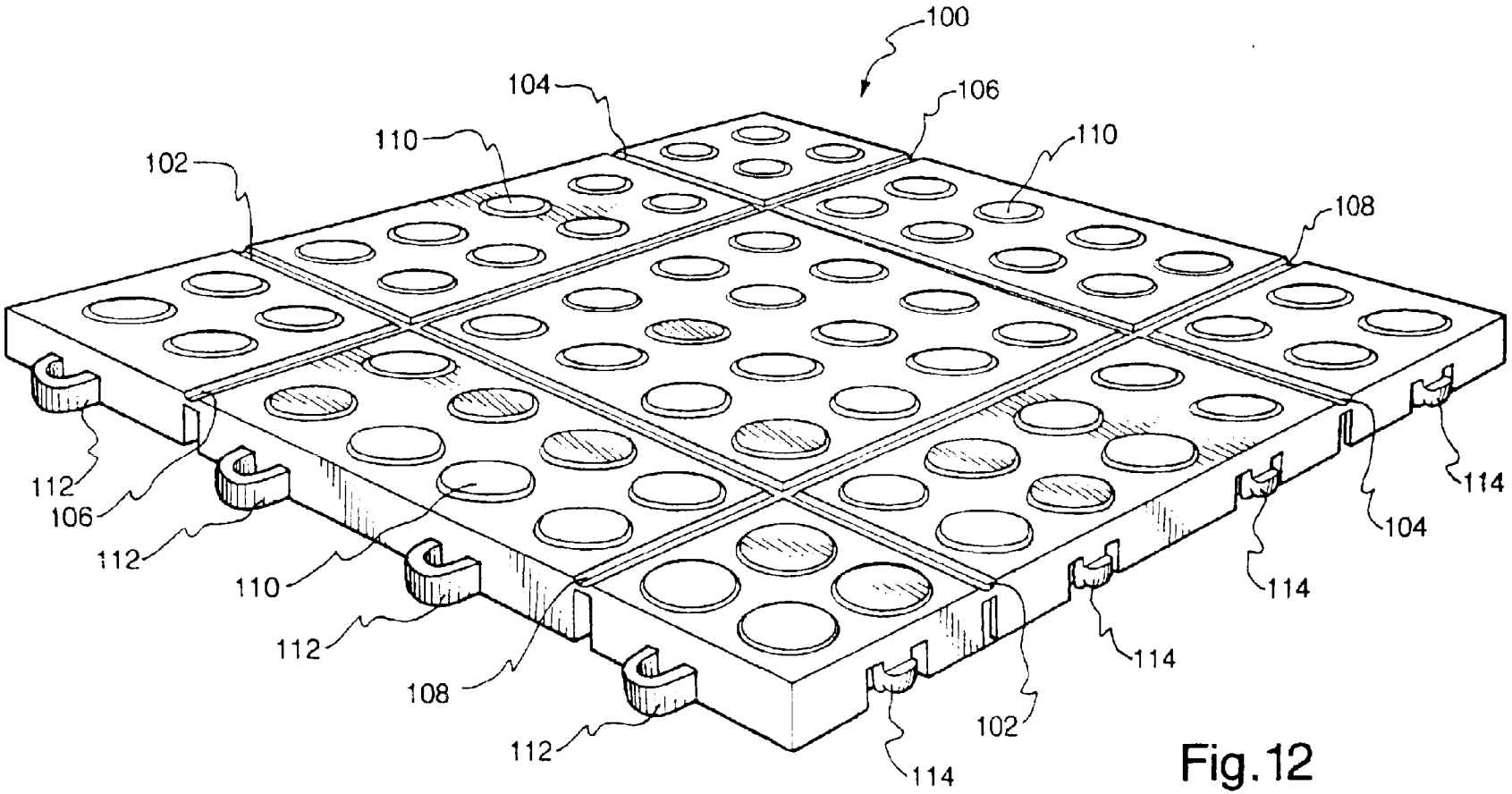
FIG. 12 is a perspective view of an alternative embodiment of the present invention.

FIG. 12 shows an alternative embodiment of a tile apparatus 100 which includes a pair of first hinges 102, 104 and a pair of second hinges 106, 108. For purposes of construction, hinges 102, 104, 106, 108 are identical to hinges 19, 20, 21, and 22 shown in the embodiment of FIGS. 1–11. The various sections defined by hinges 102, 104, 106, 108 each include raised surfaces 110, which may serve as an anti-slip surface, similar to the embodiment of FIGS. 1–11. It is to be understood that as many raised surfaces as are deemed appropriate may be included on the surface of the tile without departing from the scope of the present invention. It is also to be understood that the particular shape of the raised surfaces 110 may vary without departing from the spirit and scope of the present invention. A circular configuration is shown in FIG. 12 for purposes of simplicity.

The tile includes a plurality of loops or female members 112 along two edges (only one such edge is shown in FIG. 12) and a plurality of flanges, interlocking tabs, or male members, 114 on two sides of the tile (only one such edge is shown in FIG. 12). The male members 112 and the female members 114 function similar to the manner in which male members 16 and female members 45 function as shown in the embodiment of FIGS. 1–11. The male members 112 and female members 114 allow the tiles to be interlocked and rolled up together without becoming detached from one another.

Figure 13:
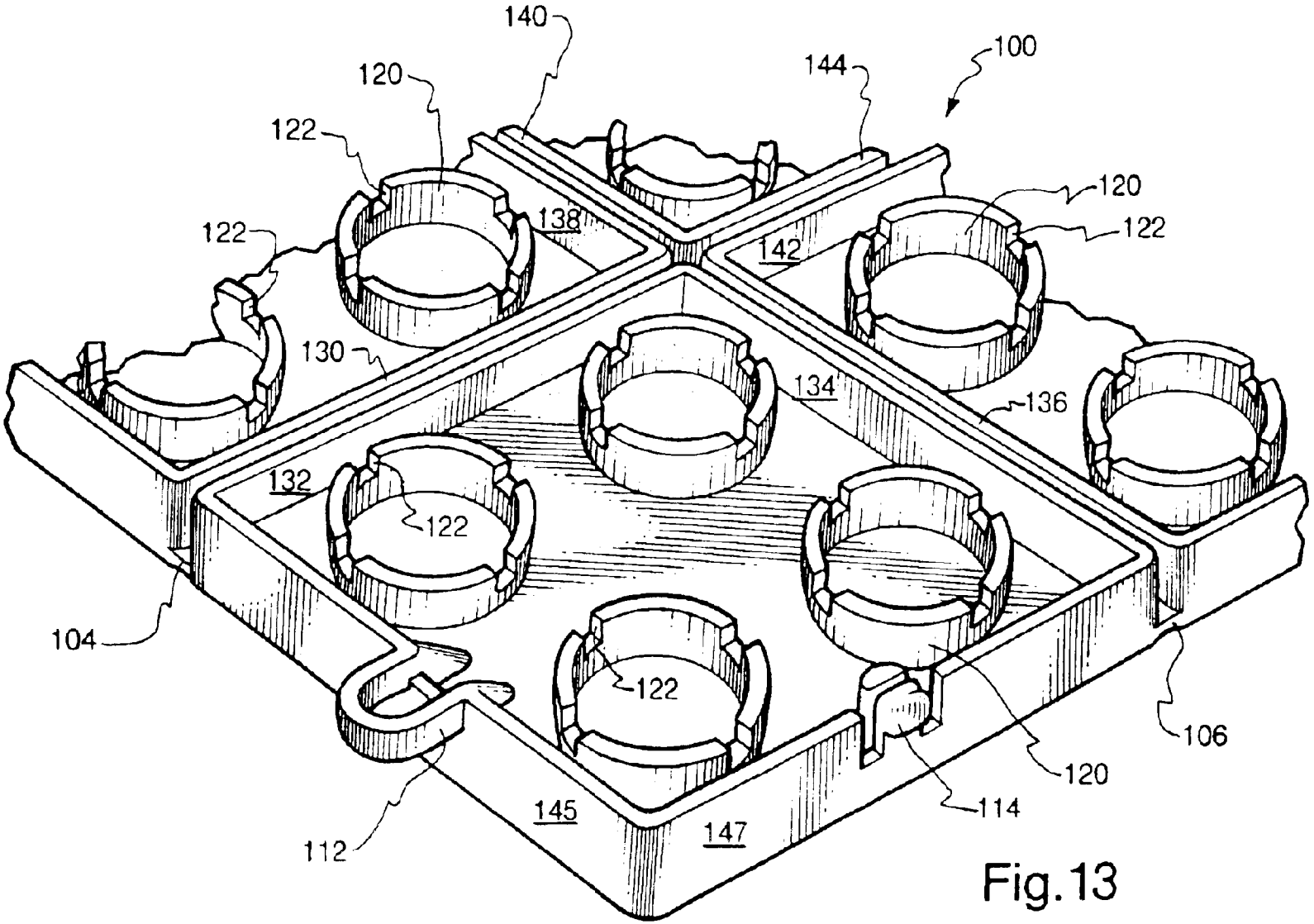
FIG. 13 is an enlarged partial perspective view, rotated 180 degrees, of the bottom side of tile apparatus shown in FIG. 12.

As shown in FIG. 13, the bottom side of tile 100 includes a plurality of circular posts or feet 120 which aid in supporting the tile. The feet 120 function in a manner similar to what is shown and described as posts 52 in FIG. 2. The posts or feet 120 shown in FIG. 13 further include notches 122 which may be aligned with one another and serve to allow drainage, where necessary, between sections of the tile.

Extending below the top surface of tile 100 are vertical walls 130, 132, 134, 136, 138, 140, 142, and 144. One purpose of these walls, in addition to vertical support, is to create a limit to upward buckling or movement of the tile 100. This purpose is substantially the same with respect to the walls on the underside of the tile as shown in FIG. 2 of the tile embodiment shown in FIGS. 1–11. When a person or some other object frictionally and transversely engages the tile (such as when a machine is driving across the tile or when a person is walking across the tile), a transverse force will be placed upon the tile. The tile may buckle upward slightly to provide a shock-absorbing function. The upward buckling or bending of the tile will be limited, however, by the engagement of adjacent walls. Therefore, with respect to the tile shown in FIG. 13, given the appropriate transverse friction and force placed on the tile apparatus during normal conditions, wall 30 may engage wall 132 and wall 142 may engage wall 144 to provide a limit to the upward buckling or bending of the tile 100. Similarly, although perpendicular relative to walls 130, 132, 142, and 144, the appropriate transverse friction and force will cause the tile to buckle and wall 134 and 136 will engage each other, as well as walls 138 and 140, to limit the upward buckling or bending of the tile. As such, the tiles, when fully assembled, and even when a single tile is isolated, will provide a shock-absorbing feature, yet the tiles will be limited in upward movement or buckling and adjacent tiles will be prevented from disengaging relative to one another. Even engagement of peripheral walls of a particular tile (such as the peripheral exterior walls 145, 147 of tile 100 will function as a stop relative to the appropriate peripheral wall of an adjacent tile to which the tile 100 is secured. It is further to be understood that apertures (not shown) may be formed in upstanding walls 130–144 (as well as the other walls not shown) so that fluid or air may flow between the various sections of the tile defined by the various vertical walls.

Figure 14:
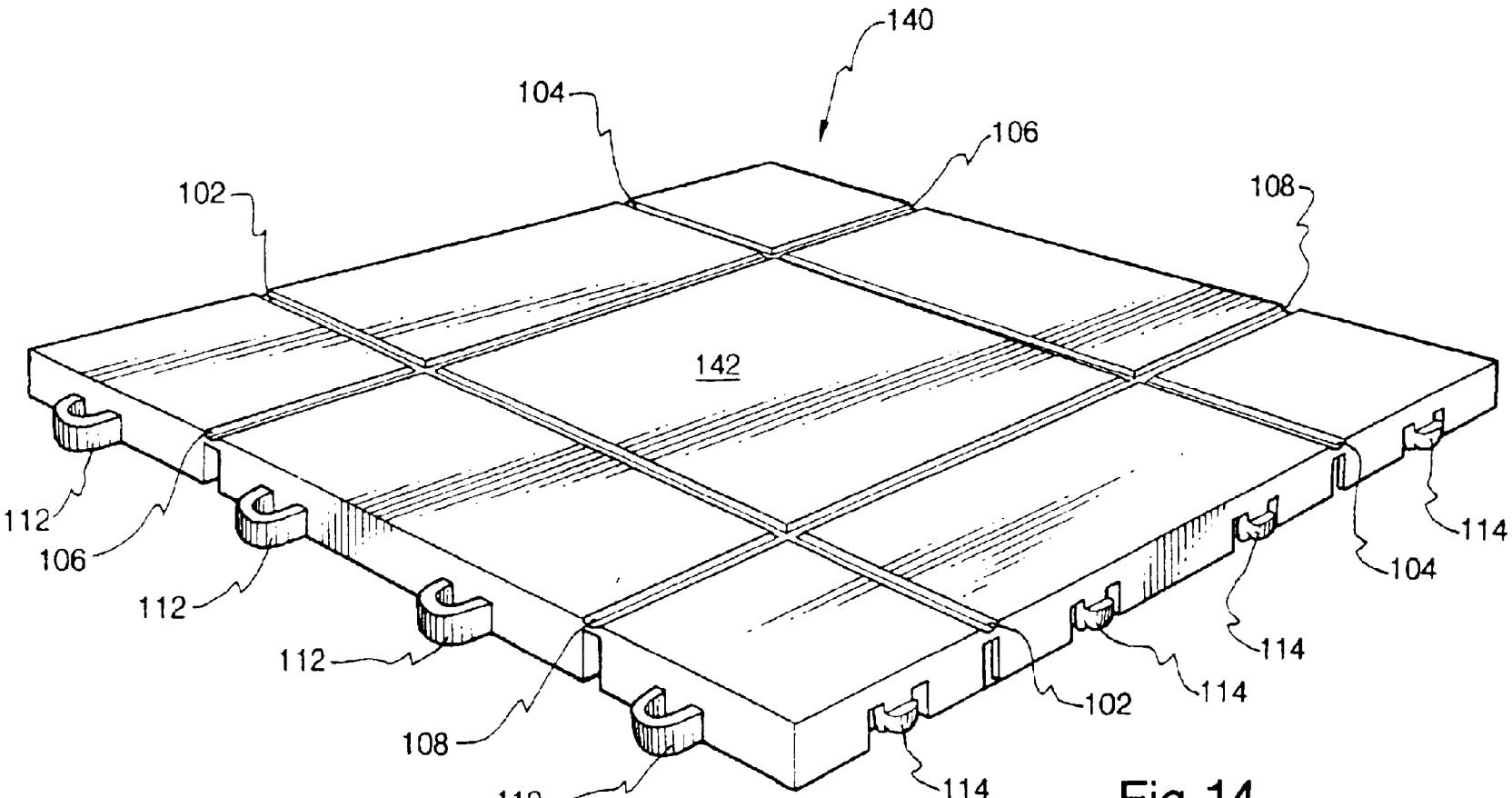
FIG. 14 is a perspective view of yet another alternative embodiment of the present invention.

FIG. 14 shows yet another embodiment identical with respect to the embodiment shown in FIGS. 12 and 13, except that the tile 140 shown in FIG. 14 includes a top surface 142, which is smooth and free of any type of protuberance or raised extensions. Only the hinges 102–108 change the topography of the top surface of tile 140. All other aspects of the tile shown in FIG. 14 are the same as those shown with respect to the embodiment of FIGS. 12 and 13.

While this invention has been described with reference to certain specific embodiments and examples, it will be recognized by those skilled in the art that many variations are possible without departing from the scope and spirit of this invention. The invention, as described by the claims, is intended to cover all changes and modifications of the invention which do not depart from the spirit of the invention. The words "including" and "having," as used in the specification, including the claims, shall have the same meaning as the word "comprising."

What is claimed is:

1. Tile for use in forming a generally flat and multi-tile traffic-carrying surface, said tile comprising:

a generally planar and square structural member having a 4d-by-4d outer dimension and having a top traffic-carrying surface and a bottom surface;

said square structural member having a first edge, a second edge that is parallel to said first edge, a third edge, and a fourth edge that is parallel to said third edge;

locking members located on said first, second, third and fourth edges for locking said tile to adjacent tile in a manner to form a generally non-bendable tile joint between said tile and said adjacent tile;

a first set of two bend line areas formed in said tile, said two bend line areas of said first set being parallel to, and located at a distance d from, said first and second edges respectively;

a second set of two bend line areas formed in said tile, said two bend line areas of said second set being parallel to, and located at a distance d from, said third and fourth edges respectively;

such that a multi-tile traffic carrying surface having a plurality of said tile locked together can be rolled up, beginning at any edge of the traffic carrying surface, into a tube having an axis;

said tube having tile panels of a width 2d that extend parallel to said axis.

2. The tile of claim 1 wherein said top surface is generally parallel to said bottom surface.

3. The tile of claim 1 wherein said top surface includes a relatively high friction surface pattern.

4. Tile for use in forming a generally flat and multi-tile traffic-carrying surface, said tile comprising:

a generally planar and square structural member having a 4d-by-4d outer dimension and having a top traffic-carrying surface and a bottom surface;

said square structural member having a first edge, a second edge that is parallel to said first edge, a third edge, and a fourth edge that is parallel to said third edge;

locking members located on said first, second, third and fourth edges for locking said tile to adjacent tile in a manner to form a generally non-bendable tile joint between said tile and said adjacent tile;

a first set of two bend line areas formed in said tile, said two bend line areas of said first set being parallel to, and located at a distance d from, said first and second edges respectively;

a second set of two bend line areas formed in said tile, said two bend line areas of said second set being parallel to, and located at a distance d from, said third and fourth edges respectively;

such that a multi-tile traffic carrying surface having a plurality of said tile locked together can be rolled up, beginning at any edge of the traffic carrying surface, into a tube having an axis;

said tube having tile panels of a width 2d that extend parallel to said axis wherein said first and second bend line areas include bend lines formed in said top surface.

5. The tile of claim 4 wherein said tile is formed of a plastic material and wherein said bend lines are embossed into said top surface.

6. The tile of claim 4 wherein said first and second bend line areas including:

stiffeners formed on said bottom surface of said tile in a manner to form a first set of two bend channels that do not include said stiffeners and that form said first set of bend line areas in said tile, and in a manner to form a second set of two bend channels that do not include said stiffeners and that form said second set of bend line areas in said tile.

7. The tile of claim 6 wherein said stiffeners include stiffening walls extending from said bottom surface.

8. The tile of claim 4 including:

a first side wall extending downward a given distance from said first edge of said square structural member;

a second side wall extending downward said given distance from said second edge of said square structural member;

a first set of two bend notches formed in said first and second side walls respectively, said two bend notches in said first and second side walls being respectively positioned to coincide with said first set of bend line areas;

a third side wall extending downward said given distance from said third edge of said square structural member;

a fourth side wall extending downward said given distance from said fourth edge of said square structural member; and a second set of two bend notches formed in said third and fourth side walls respectively, said two bend notches in said third and fourth side walls being respectively positioned to coincide with said second set of bend line areas.

9. The tile of claim 4 including:

stiffeners formed on said bottom surface of said tile in a manner to form a first set of two bend channels that do not include said stiffeners and that cooperate with said first set of bend line areas in said tile, and in a manner to form a second set of two bend channels that do not include said stiffeners and that cooperate with said second set of bend line areas in said tile;

a first side wall extending downward a given distance from said first edge of said square structural member;

a second side wall extending downward said given distance from said second edge of said square structural member;

a first set of two bend notches formed in said first and second side walls respectively, said two bend notches in said first and second side walls being respectively positioned to coincide with said first set of bend line areas in said tile;

a third side wall extending downward said given distance from said third edge of said square structural member;

a fourth side wall extending downward said given distance from said fourth edge of said square structural member; and a second set of two bend notches formed in said third and fourth side walls respectively, said two bend notches in said third and fourth side walls being respectively positioned to coincide with said second set of bend line areas in said tile.

10. The tile of claim 9 wherein said stiffeners include stiffening walls extending from said bottom surface of said tile.

11. The tile of claim 10 wherein said tile is formed of a plastic material and wherein said bend line areas include bend lines that are embossed into said top surface of said tile.

12. A method of making a generally rigid and flat floor that can be rolled up into a hollow tube for storage, comprising the steps of:

providing a plurality of rigid, flat, and square tile;

interlocking said plurality of tile to form a generally rigid and flat floor;

providing that said plurality of tile are interlocked in a manner to form a plurality of generally non-bendable tile joints;

providing that each of said tile has a 4d-by-4d outer dimension;

providing two bend line areas in each of each of said tile parallel to, and at a distance d from, a first tile edge and its opposite tile edge; and providing two bend line areas in each tile parallel to, and at a distance d from, a second tile edge and its opposite tile edge;

such that said generally rigid and flat floor can be rolled up into a hollow tube having an axis, beginning at any edge of said flat floor;

said hollow tube being made up of flat panels having a width of 2d that extend parallel to said axis of said tube.

13. Tile for use in assembling a multi-tile floor that can be rolled up into a hollow tube, said tile comprising:

a unitary and rigid tile member having a 90-degree quadrilateral planar shape;

said rigid tile member having a first width-edge, an opposite width-edge, and a width W;

said rigid tile member having a first length-edge, an opposite length-edge, and a length L;

a first bend line area formed in said rigid tile member parallel to said first width-edge and spaced from said first width-edge by a distance W/4;

a second bend line area formed in said rigid tile member parallel to said opposite width-edge and spaced from said opposite width edge by a distance W/4;

a third bend line area formed in said rigid tile member parallel to said first length-edge and spaced from said first length-edge by a distance L/4;

a fourth bend line area formed in said rigid tile member parallel to said opposite length-edge and spaced from said opposite length-edge by the distance L/4; and tile interlocking means formed on said first width-edge, said opposite width-edge, said first length-edge and said opposite length-edge for use in forming generally non-bendable tile joint lines between adjacent tile of said multi-tile floor.

14. The tile of claim 13 wherein said 90-degree quadrilateral planar shape is a square.

15. The tile of claim 13 wherein said rigid tile member includes a bottom surface, and tile stiffeners formed in portions of said bottom surface exclusive of said first, second, third and fourth bend line areas.

16. The tile of claim 13 wherein said 90-degree quadrilateral planar shape is a square.

17. Tile for use in assembling a multi-tile floor that can be rolled up into a hollow tube as desired, said tile comprising:

a unitary and rigid tile member having a 90-degree quadrilateral planar shape;

said rigid tile member having a first width-edge, an opposite width-edge, and a width W;

said rigid tile member having a first length-edge, an opposite length-edge, and a length L;

a first bend line area formed in said rigid tile member;

said first bend line area being selectively located either parallel to said a first width-edge and spaced from said first width-edge by a distance W/4, or parallel to said first length-edge and spaced from said first length-edge by a distance L/4;

a second bend line area formed in said rigid tile member;

said second bend line area being located parallel to said opposite width-edge and spaced from said opposite width edge by a distance W/4 when said first bend line area is located parallel to said a first width-edge and is spaced from said first width-edge by said distance W/4;

said second bend line area being located parallel to said opposite length-edge and spaced from said opposite length edge by a distance L/4 when said first bend line area is located parallel to said first length-edge and is spaced from said first length-edge by said distance L4; and tile interlocking means formed on said first width-edge, said opposite width-edge, said first length-edge and said opposite length-edge for use in forming generally non-bendable tile joint lines between adjacent tile of said multi-tile floor.

18. The tile of claim 17 wherein said 90-degree quadrilateral planar shape is a square.

19. The tile of claim 17 wherein said rigid tile member includes a bottom surface, and tile stiffeners formed in portions of said bottom surface exclusive of said first and second bend line areas.

20. The tile of claim 17 wherein said 90-degree quadrilateral planar shape is a square.

* * * * *